United States Patent [19]

Dowing et al.

[11] Patent Number: 4,945,808

[45] Date of Patent: Aug. 7, 1990

[54] PRIMER

[75] Inventors: Richard Dowing, Torquay; Jolanta Paull, Hawthorn; David Vince, Essendon, all of Australia

[73] Assignee: ICI Australia Operations Proprietary Limited, Melbourne, Australia

[21] Appl. No.: 324,470

[22] Filed: Mar. 16, 1989

Related U.S. Application Data

[62] Division of Ser. No. 146,127, Jan. 20, 1988, Pat. No. 4,879,952.

[30] Foreign Application Priority Data

Jan. 30, 1987 [AU] Australia ..... PI0122

[51] Int. Cl.[5] ..... F42B 3/00

[52] U.S. Cl. ..... 86/20.12; 102/315; 102/318; 102/331

[58] Field of Search ..... 86/20.12; 102/321, 332, 102/318, 315

[56] References Cited

U.S. PATENT DOCUMENTS

| | | | |
|---|---|---|---|
| 3,037,452 | 6/1962 | Cook et al. | 102/332 |
| 3,037,453 | 6/1962 | Cook et al. | 102/332 |
| 3,136,831 | 6/1962 | Zinn | 86/20.12 |
| 3,747,527 | 7/1973 | Griffith | 102/318 |
| 3,768,411 | 10/1973 | Maes et al. | 102/315 |
| 4,023,494 | 5/1977 | Barton et al. | 102/331 |
| 4,141,296 | 2/1979 | Calder et al. | 102/318 |
| 4,383,484 | 5/1983 | Morrey | 102/331 |
| 4,409,155 | 10/1983 | Bonnycastle et al. | 86/20.12 |
| 4,527,482 | 7/1985 | Hynes | 102/331 |
| 4,776,276 | 10/1988 | Yunan | 102/318 |

*Primary Examiner*—David H. Brown

*Attorney, Agent, or Firm*—Cushman, Darby & Cushman

[57] ABSTRACT

A primer for an explosive charge which is to be initiated by a fuse cord is sensitized by a loose charge of a high explosive, this high explosive being contained in a rigid, impermeable container which is so shaped that at least partially surrounds the fuse cord. The container is of plastics or metal and preferably comprises at least one elongated concave surface which mates with and is supported by at least one metal rod which protrudes from the base of a mold in which the primer will be cast and which establishes a channel for a fusecord.

The primers of this invention have more sensitivity and robustness than known primers, and wire fusecords of lower charge weight.

1 Claim, 2 Drawing Sheets

PRIMER

This is a division of application Ser. No. 07/146,127, filed Jan. 20, 1988now U.S. Pat. No. 4,829,752.

This invention relates to a primer for the detonation of an explosive charge.

A well-known means of detonating a main charge of explosive for the breaking of rock and ore is by means of a primer, that is, a small charge of solid explosive which is initiated by means of a detonating cord. The reliable initiation of the primer explosive has required detonating cords of relatively high charge weight, that is, having a high weight of high explosive for a given length of cord. A cord of sufficient charge weight to ignite a primer reliably has undesirable side effects, such as side initiation (the compression of the main charge in the immediate vicinity of the cord with resultant loss of sensitivity) whereas a cord having a charge weight low enough to avoid these side effects will not reliably initiate the primer.

One means of overcoming this problem has been the incorporation in the primer charge of a small charge of high explosive to sensitize the primer charge.

This is generally done during the manufacture of the primer. Primers are usually made by casting molten solid explosive in moulds, the molten primer charge being then allowed to set. It is common to have protruding from such moulds a cylindrical rod of essentially the same diameter as the detonating cord, such that a suitable passage for the insertion of the cord is provided and the cord can readily be fitted to the primer charge on its removal from the mould. The sensitizing charge is usually added sealed in a flexible container, commonly a balloon. Many moulds have a second cylindrical rod which is parallel to the first but which does not necessarily protrude from the mould, this being present to allow for the tying of the detonator cords or for detonator priming. The balloon containing the sensitizing charge is wedged between these rods and moved into position prior to the casting of the primer. A detonating cord inserted in the resultant solid charge will thus contact the balloon.

This type of primer has been successful in practice but still suffers from drawbacks. One of these is the fragility of balloons which can break in the process of making the primer. Another is the permeability of balloons to oil and water, especially under pressure (for example, at the bottom of a charge of explosive). Two further disadvantages are the expense of filling the balloons and the fact that the sensitizing explosive is packed tightly in the balloons, which reduces sensitivity.

It has now been found that these disadvantages may be eliminated or substantially reduced by the primers of the present invention. There is therefore provided, according to the present invention, a primer for an explosive charge, adapted to be fired by a detonating cord, the primer comprising a charge of explosive substantially completely surrounding a sensitizing charge of high explosive, the sensitizing charge being enclosed within an impermeable rigid container whose external shape is adapted to at least partially surround the circumference of the detonating cord.

The primer charge may be selected from any suitable material. It may be, for example, a solid explosive such as TNT, RDX, Tetryl and PETN and mixtures thereof. For the purposes of this invention, it is preferred that the explosive of the primer charge be solid. However, it is possible and permissible to use liquid explosives in the working of this invention. Particularly useful liquid explosives for the purposes of this invention are the emulsion explosives well known to the art. These range in consistency from thick semi-solid pastes to reasonably free-flowing liquids.

The primer is adapted to be fired by a detonating cord, that is, the primer either comprises a detonating cord integral therewith as a result of the process of production, or it has provision for the incorporation of such a cord such as a hole produced, for example, by means of a rod in a mould as hereinabove described. The detonating cord may be selected from any suitable detonating cord known to the art.

The sensitizing explosive may be selected from the high explosives known to the art to be suitable for such a use, for example, Tetryl, PETN, RDX and mixtures thereof.

The container within which the sensitizing explosive is housed is rigid and impermeable. By "rigid" is meant that the container is constructed such that it substantially retains its shape under conditions of use, and by "impermeable" is meant that the container will not permit the entry thereinto of any external substance under conditions of use. The container may be made from any suitable material such as plastics and metals, plastics being particularly suitable materials for the containers as they can easily and cheaply be moulded into any desired shape An important feature of this container is that its external shape is adapted to at least partially surround the circumference of the detonating cord. In practical terms, this means that the container is so shaped as to provide an elongate concave or cylindrical surface which mates with the external surface of the detonating cord thus allowing close contact. It is possible to mould containers which will surround most or even all of the circumference of the cord.

The primers of this invention may be prepared by any convenient means. For example, a container may be mated to a cord and this placed in a container and primer explosive cast or poured around it. In the case of solid or very viscous explosives, it is preferred, however, to use the method known to the art and described hereinabove, that is, the use of a mould having at least one rod, at least one of which provides a cylindrical hole completely through the primer. The invention therefore also provides a method of manufacture of a primer by casting molten primer explosive in a mould, the mould having at least one rod at least one of which is so dimensioned as to provide in the primer a cylindrical hole extending completely therethrough, there being placed in the mould prior to casting a sensitizing charge, the sensitizing charge being enclosed in a rigid impermeable container whose external shape is such that it at least partially surrounds a hole-providing rod and is supported thereby.

It is preferred to use a mould having at least two parallel rods—such moulds are well known to and widely used by the art. The container for use in such a mould has two concave elongate depressions on opposite sides thereof, and the container is so dimensioned that these depressions mate with the two rods and locate the container in place in the mould.

The rod which creates the cylindrical hole extending through the finished primer has substantially the same diameter as a detonating cord which is to be used with the primer. This means of course that a detonating cord inserted into the hole will contact the container with the sensitizing charge.

The sensitizing charge should be substantially completely surrounded by the primer charge, and this can be assured by providing on the container at least one leg which prevents the main body of the container from touching the bottom of the mould. Such legs are easily incorporated, especially in plastics containers, and in a preferred embodiment a single leg extends from the bottom of the container in a direction parallel to the axis of the rod.

The sensitizing charge is easily loaded to a container of the type described hereinabove and the container may be closed by any suitable means such as a stopper. The closing means must of course perform properly in the environment in which the primer will be used It must, for example, be impermeable, and it may need to have other characteristics such as resistance to pressure. Those skilled in the art will readily be able to select appropriate closing means and neck configurations to meet any circumstances. An especially useful, convenient and cheap closing means is a sphere of silicone rubber which is so sized as to fit into a neck of the container.

An especially valuable feature of this invention is the fact that the sensitizing charge may be added loosely to the container and it will remain thus. This confers greater sensitivity on the sensitizing charge and permits of the use of detonating cords of even lower sensitivity than have previously been possible to be used.

The invention will now be further illustrated with reference to the drawings which depict a preferred embodiment.

Figure 1:
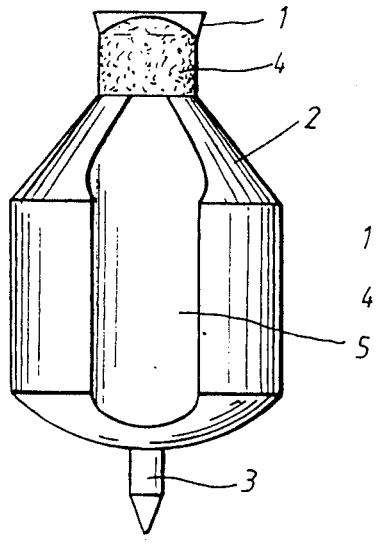
FIG. 1 is a side elevational view of a container for a sensitizing charge.
Figure 2:
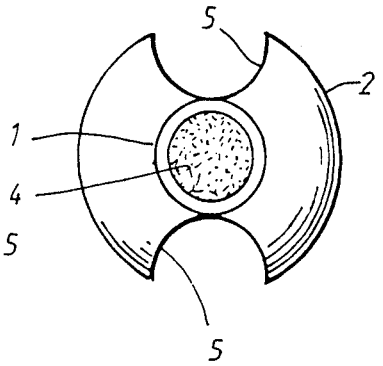
FIG. 2 is a plan view of the container of FIG. 1.

The container depicted in FIG. 1 is a bottle moulded from plastics material. It comprises a neck portion 1, a body portion 2 and a leg 3 protruding from the bottom of the body portion 2. The neck is stoppered after the bottle has received its sensitizing charge with a plug 4 which is typically a ball of silicone rubber. The body portion 2 has incorporated into its shape two elongate concave depressions 5 which are on opposite sides of the bottle and whose longitudinal axes parallel that of the bottle itself.

Figure 3:
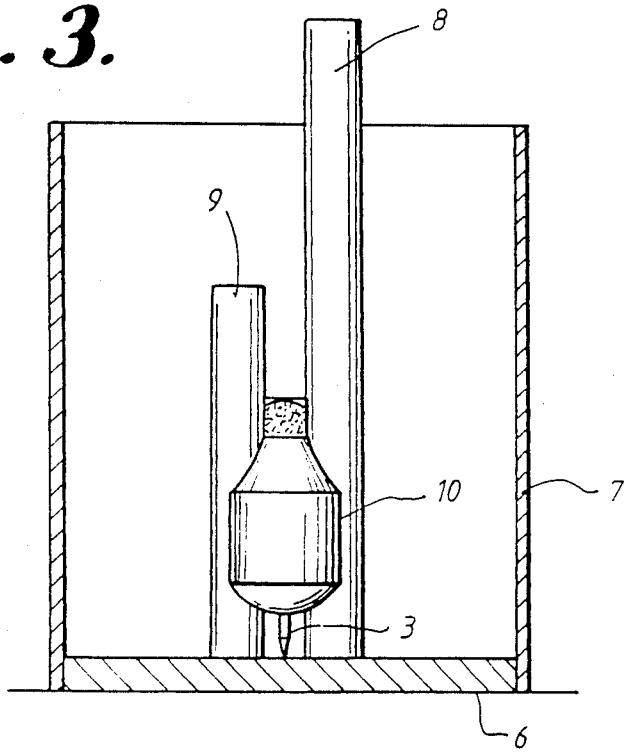
FIG. 3 is a part vertical section of a mould for the making of a primer according to the invention, showing a container of the type depicted in FIG. 1 in place prior to the pouring of molten primer explosive.

FIG. 3 shows the container of FIG. 1 in place in a mould The mould comprises a circular base plate 6 and a removable sleeve 7 which is a tight fit around the base plate. Extending vertically from the base plate are two vertical cylindrical rods 8, 9, rod 8 being taller than the sleeve and rod 9 being shorter than the sleeve; the result is that when the mould is filled with molten primer explosive, rod 8 protrudes clear of the explosive and the resulting primer will have a cylindrical hole extending along its entire length. Rod 8 is of the same diameter as a detonating cord which will be used with the primer.

A container for a sensitizing charge 10 fits between the rods 8 and 9, the container being so shaped and dimensioned that the elongate concave depressions 5 mate with the rods and hold the container in a vertical position in the mould. The leg 3 protruding from the bottom of the container supports the container clear of the baseplate and allows the molten explosive to substantially completely surround the sensitizing charge.

Figure 4:
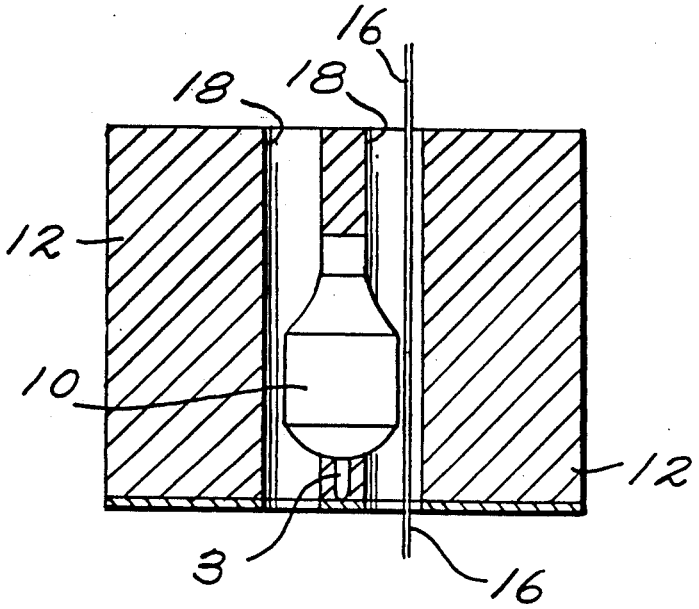
FIGS. 4 and 5 are vertical sectional views of primers according to the invention.
Figure 5:
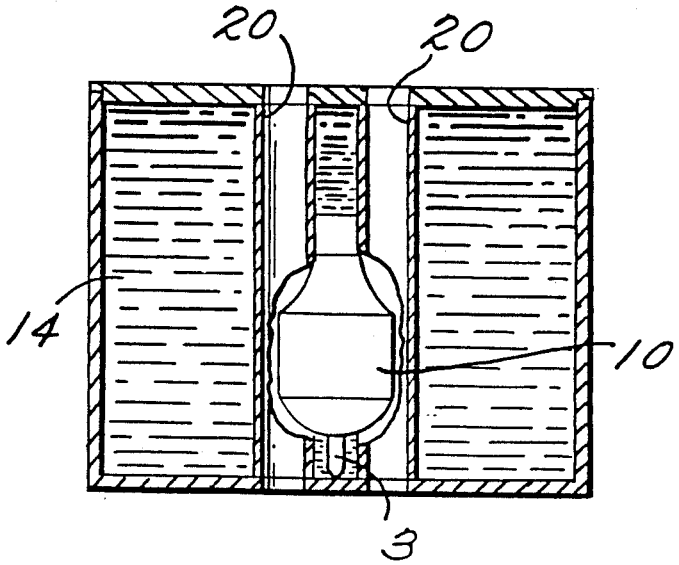

FIG. 4 shows a primer according to the invention where the explosive charge is a solid 12 while FIG. 5 illustrates the primer when the explosive charge is a liquid or emulsion 14. In the case of the primer of FIG. 4, it will be appreciated that the detonating cord 16 can be inserted through the conduit or hole 18 formed by removal of the rods 8 and 9. In the case of FIG. 5, where the explosive is a liquid or emulsion, tubes 20 are provided to receive the detonating cord 16.

We claim:

1. A method of manufacture of a primer which comprises providing a mould having therein at least one rod which is so dimensioned as to provide in the primer, when the primer is cast in the mould, a cylindrical hole extending completely therethrough, providing a sensitizing charge enclosed in a rigid impermeable container whose external shape is such that it at least partially surrounds the hole-providing rod of said mould, placing in the mould prior to casting the sensitizing charge enclosed in said rigid impermeable container so that it at least partially surrounds the hole-providing rod and is supported thereby and then casting molten primer explosive in said mould so that the molten explosive surrounds said container allowing the primer explosive to set and removing the same with the container therein from the mould.

* * * * *